US010510333B1

(12) United States Patent
Kim

(10) Patent No.: US 10,510,333 B1
(45) Date of Patent: Dec. 17, 2019

(54) VEHICLE AND METHOD OF CONTROLLING THE SAME

(71) Applicants: HYUNDAI MOTOR COMPANY, Seoul (KR); KIA MOTORS CORPORATION, Seoul (KR)

(72) Inventor: Young Kim, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/352,291

(22) Filed: Mar. 13, 2019

(30) Foreign Application Priority Data

Oct. 30, 2018 (KR) ..... 10-2018-0130391

(51) Int. Cl.
*G10K 11/178* (2006.01)

(52) U.S. Cl.
CPC ..... *G10K 11/17823* (2018.01); *G10K 2210/1282* (2013.01); *G10K 2210/501* (2013.01)

(58) Field of Classification Search
CPC ..... G10K 11/17823; G10K 11/1788; G10K 11/178; G10K 11/1786; G10K 11/1784; G10K 2210/1282; G10K 2210/501; G10K 2210/12; G10K 2210/121; G10K 2210/128; G10K 2210/12821; G10K 2210/129; H04R 2499/13
USPC ..... 381/71.4, 71.1, 96, 365, 389, 302
See application file for complete search history.

(56) References Cited

U.S. PATENT DOCUMENTS 5,617,315 A * 4/1997 Nakao ..... G10K 11/178 701/36
2010/0082274 A1* 4/2010 Son ..... G01H 1/00 702/56
2010/0124337 A1* 5/2010 Wertz ..... G10K 11/178 381/71.11
2016/0163304 A1* 6/2016 Lee ..... G10K 11/1781 381/71.4
2018/0293812 A1* 10/2018 Miller ..... H04R 29/001
2018/0301137 A1* 10/2018 Pfaffinger ..... G10K 11/17853

FOREIGN PATENT DOCUMENTS

JP 05288237 A * 11/1993
JP 2009061912 A * 3/2009

* cited by examiner

*Primary Examiner* — Ahmad F. Matar
*Assistant Examiner* — Sabrina Diaz
(74) *Attorney, Agent, or Firm* — McDonnell Boehnen Hulbert & Berghoff LLP

(57) ABSTRACT

Provided are a vehicle capable of detecting an occurrence of a fault of a noise control device of the vehicle and indicating a result of the detection to a user upon occurrence of a fault such that the user handles the fault, and a method of controlling the same, the method including outputting an acoustic signal having a predetermined frequency through a speaker; detecting the acoustic signal output through the speaker; detecting a vibration generated by the acoustic signal output through the speaker; and determining that a fault has occurred when the detected acoustic signal and the detected vibration mismatch the acoustic signal having the predetermined frequency.

14 Claims, 3 Drawing Sheets

VEHICLE AND METHOD OF CONTROLLING THE SAME

CROSS REFERENCE TO RELATED APPLICATION

This application is based on and claims priority under 35 U.S.C. § 119 to Korean Patent Application No. 10-2018-0130391, filed on Oct. 30, 2018 in the Korean Intellectual Property Office, the disclosure of which is incorporated herein by reference.

BACKGROUND

1. Field

The present disclosure relates to a vehicle, and more specifically, to an apparatus for controlling noise of a vehicle.

2. Description of the Related Art

Generally, convenience devices for vehicles are consistently being developed for drivers and passengers. There has been recent development on a technique for eliminating noise generated in a vehicle through an audio device. Factors that cause the internal noise of the vehicle may include engine driving, roughness of a road surface, and sound of wind introduced during travelling.

A method of eliminating such noise is divided into a passive noise control method for eliminating noise by installing a sound absorbing material capable of absorbing noise in a vehicle, and an active noise control (ANC) method for canceling a noise signal by generating a control signal with an inverted phase to the noise signal. Consumers prefer the active noise control that outperforms the passive noise control.

However, even when such a noise control device has a fault, the user may have difficulty in recognizing the occurrence of the fault. Accordingly, when the noise control device has a fault, the user may mistake the fault of the noise control device for a fault of the vehicle, which may lead to complaints about the vehicle. Accordingly, there is a need for a technology allowing general users rather than experts to easily recognize a fault of the noise control device of the vehicle.

SUMMARY

Therefore, it is an object of the present disclosure to provide a technology capable of detecting an occurrence of a fault of a noise control device of a vehicle and indicating a result of the detection to a user upon occurrence of a fault such that the user handles the fault.

Additional aspects of the disclosure will be set forth in part in the description which follows and, in part, will be obvious from the description, or may be learned by practice of the disclosure.

Therefore, it is an aspect of the present disclosure to provide a method of controlling a vehicle including: checking whether the vehicle is in non-operation based on the state of an engine and a door of the vehicle; outputting an acoustic signal having a predetermined frequency through a speaker when the vehicle is in non-operation; detecting, by a microphone, the acoustic signal output through the speaker; detecting, by an acceleration sensor, a vibration generated by the acoustic signal output through the speaker; determining, by a controller, that a fault has occurred when the detected acoustic signal and the detected vibration mismatch the acoustic signal having the predetermined frequency; and displaying, on a display, an error code corresponding to the fault when it is determined that the fault has occurred.

The vehicle may be determined to be in non-operation when the engine of the vehicle is in ignition-off and the door of the vehicle is locked.

The error code may be an error code indicating a fault of a noise control device.

The vibration may be a vibration generated by the acoustic signal, output through the speaker, which vibrates a vehicle body panel of the vehicle.

The vibration may be detected through an acceleration sensor.

The predetermined frequency may be continuously increased by a predetermined increment within a predetermined range of frequencies.

The speaker for outputting the acoustic signal, a microphone for detecting the acoustic signal, and an acceleration sensor for detecting the vibration may be provided in each of seats of the vehicle, and the determining of the fault is sequentially performed on each of the seats.

It is another aspect of the present disclosure to provide a vehicle including: a speaker configured to output an acoustic signal having a predetermined frequency; a microphone configured to detect the acoustic signal output through the speaker; an acceleration sensor configured to detect a vibration generated by the acoustic signal output through the speaker; and a controller configured to check whether the vehicle is in non-operation, determine that a fault has occurred when the detected acoustic signal and the detected vibration mismatch the acoustic signal having the predetermined frequency while the vehicle is in non-operation, and display an error code on a display corresponding to the fault when it is determined that the fault has occurred.

The controller may output the acoustic signal having the predetermined frequency when the vehicle is in non-operation.

The controller may determine the vehicle to be in non-operation when an engine of the vehicle is in ignition-off and a door of the vehicle is locked.

The error code may be an error code indicating a fault of a noise control device.

The vibration may be a vibration generated by the acoustic signal, output through the speaker, which vibrates a vehicle body panel of the vehicle.

The predetermined frequency may be continuously increased by a predetermined increment within a predetermined range of frequencies.

The speaker, the microphone, and the acceleration sensor are provided in each of seats of the vehicle, and the determining of the fault is sequentially performed on each of the seats.

BRIEF DESCRIPTION OF THE FIGURES

These and/or other aspects of the disclosure will become apparent and more readily appreciated from the following description of the embodiments, taken in conjunction with the accompanying drawings of which.

DETAILED DESCRIPTION

Figure 1:
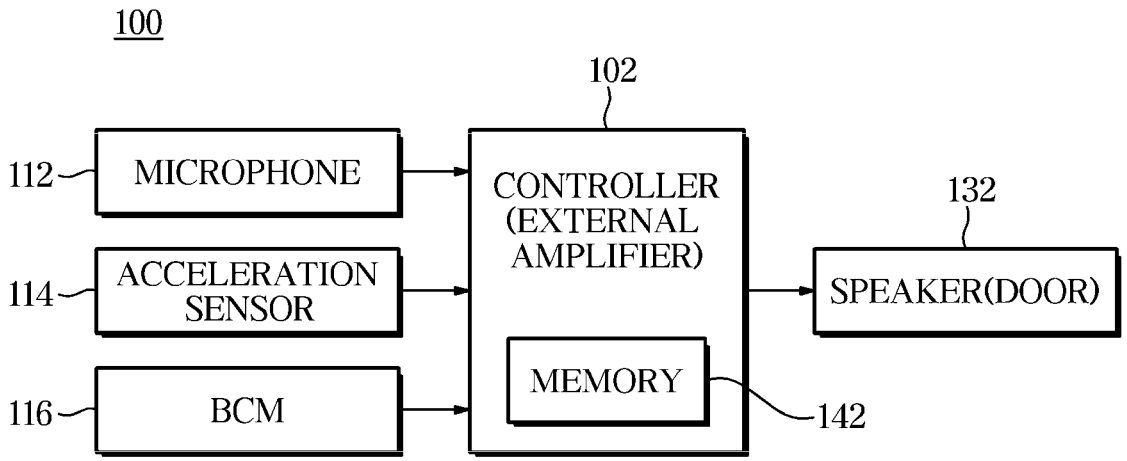
FIG. 1 is a view illustrating a control system of a noise control device for a vehicle according to an embodiment of the present disclosure.

FIG. 1 is a view illustrating a control system of a noise control device for a vehicle 100 according to an embodiment of the present disclosure. Referring to FIG. 1, an external amplifier serves as a controller 102. A microphone 112, an acceleration sensor 114, and a body control module (BCM) 116 are connected to an input side of the controller 102 to communicate with the controller 102. A speaker 132 is connected to an output side of the controller 102. The controller 102 is provided with a memory 142.

The controller 102 outputs an acoustic signal with a specific frequency for diagnosing a fault, through the speaker 132. The acoustic signal output through the speaker 132 vibrates a part of a vehicle body panel of the vehicle 100. That is, the speaker 132 and the part of the vehicle body panel serve as an exciter to generate vibration. When the acoustic signal with a specific frequency is output through the speaker 132, the acoustic signal may have a maximum sound pressure.

The microphone 112 receives the acoustic signal output through the speaker 132. Information (for example, frequency information) related to the acoustic signal received through the microphone 112 is transmitted to the controller 102. The controller 102 checks whether the information related to the acoustic signal obtained through the microphone 112 matches information related to the acoustic signal output through the speaker 132 matches on the basis of the information of the acoustic signal obtained through the microphone 112. For example, when the frequency of the acoustic signal output through the speaker 132 is 50 Hz, the controller 102 checks whether the frequency of the acoustic signal received through the microphone 112 is 50 Hz, to determine whether an acoustic signal having the same frequency as that of the acoustic signal output through the speaker 132 is normally received through the microphone 112.

The acceleration sensor 114 detects vibration generated by the acoustic signal output through the speaker 132. Information related to the vibration detected through the acceleration sensor 114 is transmitted to the controller 102. The controller 102 checks whether the information related to the acoustic signal outputted through the speaker 132 matches the vibration information detected through the acceleration sensor 114 on the basis of the vibration information obtained through the acceleration sensor 114. For example, when the frequency of the acoustic signal output through the speaker 132 is 50 Hz, the controller 102 checks whether the vibration information detected through the acceleration sensor 114 corresponds to a vibration generated by an acoustic signal with 50 Hz to determine whether a vibration corresponding to the acoustic signal output through the speaker 132 is normally detected through the acceleration sensor 114. In an actual driving mode of the vehicle rather than a fault diagnosis mode, the controller 102 generates an acoustic signal with an inverted phase for cancelling noise on the basis of the acoustic information detected through the microphone 112 and the vibration information detected through the acceleration sensor 114. According to the canceling of noise using the acoustic signal with an inverted phase, noise generated during driving eliminated so that the vehicle may be driven with the silence.

The BCM 116 detects an ignition-off of an engine and a locking of doors of the vehicle 100. For example, when the user turns off ignition of the vehicle 100 and locks the doors, the BCM 116 detects the ignition off state of the engine and the door-locked state of the doors and transmits the detection result to the controller 102. The controller 102 receives the detection result that the engine is in ignition-off and the doors are locked from the BCM 116. In the vehicle 100 according to the embodiment of the present disclosure, the controller 102 diagnoses a fault of a noise control device when the vehicle 100 is in non-operation. The controller 102 determines that the vehicle 100 is in non-operation when the engine of the vehicle 100 is in the ignition-off state and the doors are in the door-locked state, and diagnoses whether the noise control device has a fault. To this end, the controller 102 receives the detection result regarding the engine ignition-off state and the door-locked state.

As described above, the speaker 132 outputs an acoustic signal with a specific frequency for fault diagnosis in response to a command from the controller 102. The speakers 132 may be each provided on a door of a driver's seat doors of passenger seats, or doors of rear seats.

The memory 142 provided in the controller 102 may be a storage medium used by the controller 102, upon occurrence of a fault of the noise control device, to generate an error code related to the fault and store the generated error code therein. The fault diagnosis of the noise control device of the vehicle 100 according to the embodiment of the present disclosure is performed in a state in which the user turns off the ignition of the engine and locks the doors. Accordingly, the controller 102 stores an error code according to a fault diagnosis in the memory 142 and displays the error code stored in the memory 142 on a cluster or the like when the engine is turned on at a later time such that the user determines whether the noise control device has a fault.

Figure 2:
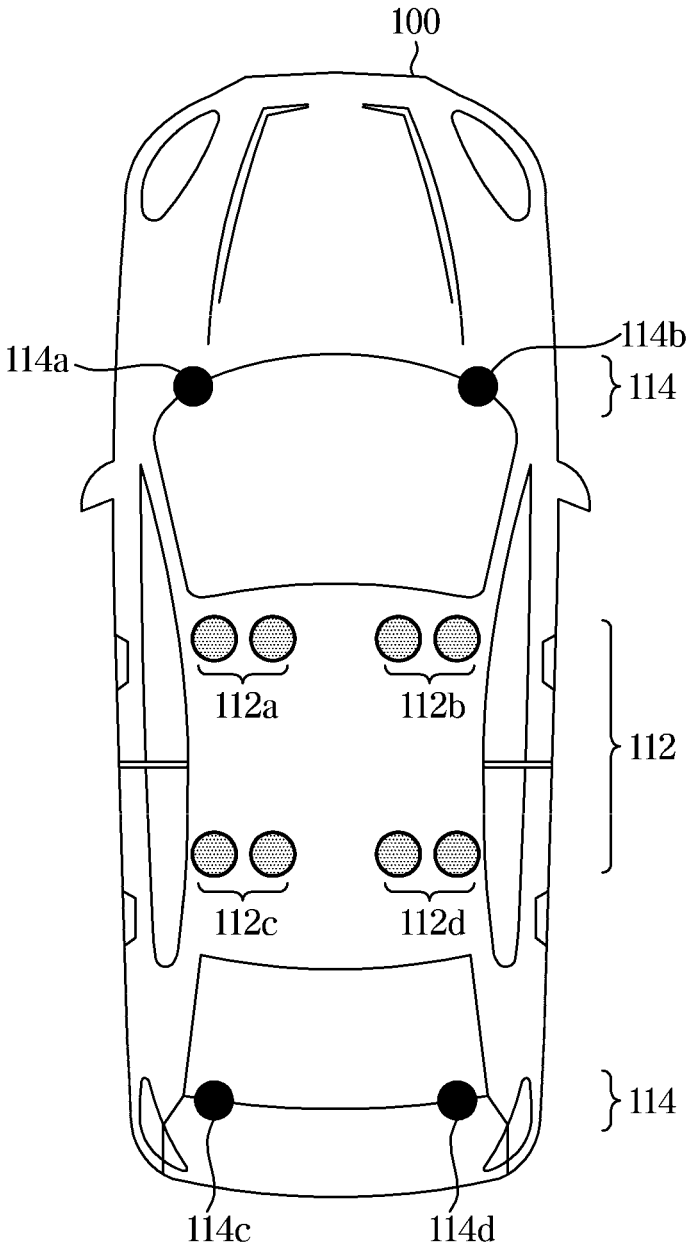
FIG. 2 is a view illustrating an installation position of a microphone and an acceleration sensor of a vehicle according to an embodiment of the present disclosure.

FIG. 2 is a view illustrating an installation position of a microphone and an acceleration sensor of a vehicle according to an embodiment of the present disclosure.

Referring to FIG. 2, the microphone 112 is provided in pairs in each of the driver's seat, the passenger seat, the left rear seat, and the right rear seat. In addition, the acceleration sensor 114 is also provided in pairs in each of the driver's seat, the passenger seat, the left rear seat, and the right rear seat.

The controller 102 first performs fault diagnosis on the noise control device using a microphone 112*a* and an acceleration sensor 114*a* provided in the driver's seat, performs fault diagnosis on the noise control device using a microphone 112*b* and an acceleration sensor 114*b* provided in the passenger seat, performs fault diagnosis on the noise control device using a microphone 112*c* and an acceleration sensor 114*c* provided in the left rear seat, and performs fault diagnosis on the noise control device using a microphone 112*d* and an acceleration sensor 114*d* provided in the rear right seat.

Figure 3:
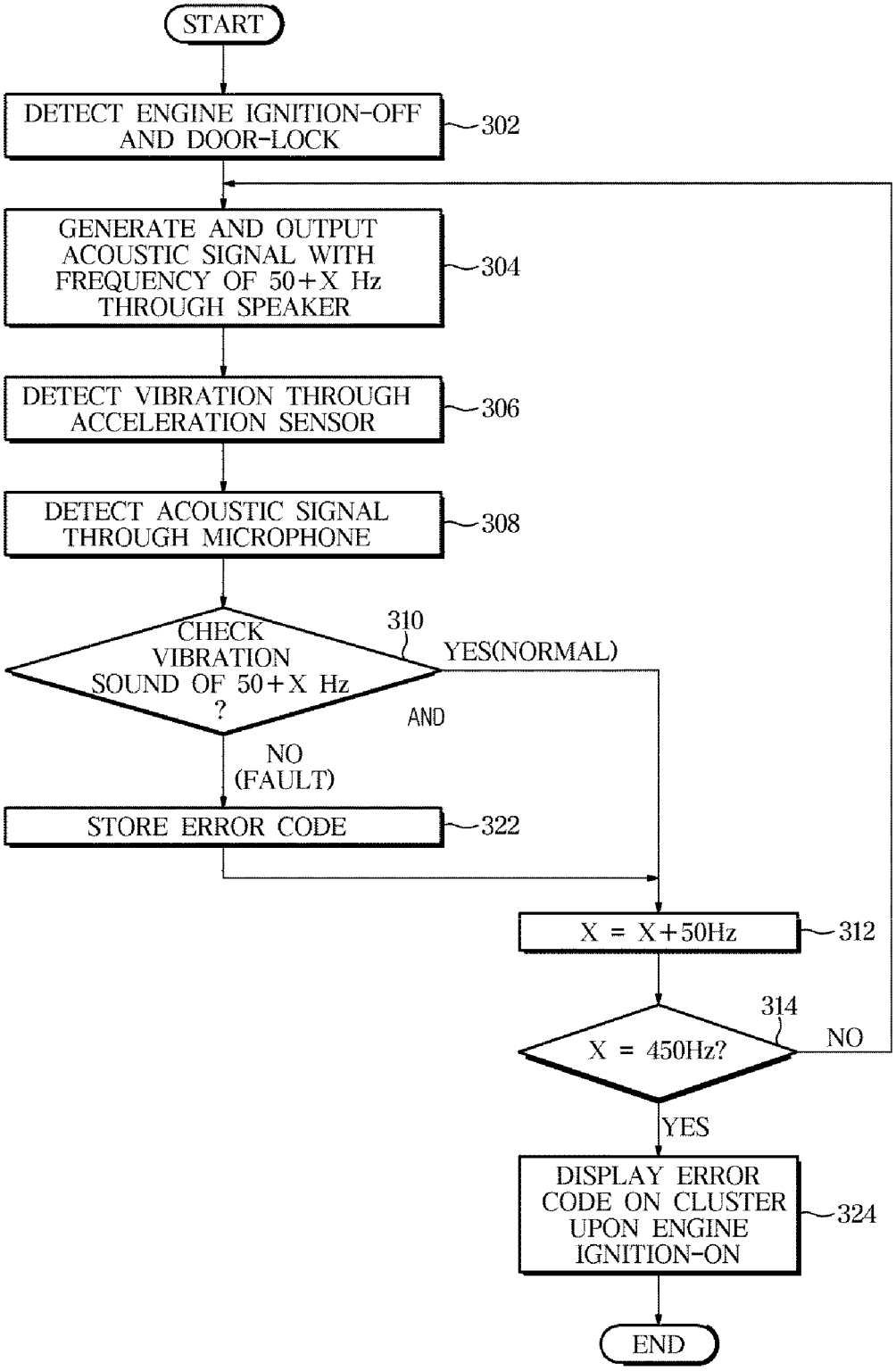
FIG. 3 is a view showing a method of diagnosing a noise control device according to an embodiment of the present disclosure.

FIG. 3 is a view showing a method of diagnosing a noise control device according to an embodiment of the present disclosure.

Referring to FIG. 3, the controller 102 detects the engine ignition-off and the door-lock of the vehicle 100 through the BCM 116 (302). In the vehicle 100 according to the embodiment of the present disclosure, the controller 102 diagnoses the fault of the noise control device when the vehicle 100 is in non-operation (e.g., with no occupant in the vehicle). The controller 102 determines that the vehicle 100 is in non-operation when the engine of the vehicle 100 is in an off-state and the doors are in a locked-state, and diagnoses whether the noise control device has a fault. To this end, the controller 102 receives a result of detection regarding the engine ignition-off and the door-locked state from the BCM 116. In order to diagnose the fault of the noise control device in the vehicle 100 according to the embodiment of the present disclosure, noise of a certain frequency needs to be generated several times. When the fault diagnosis is performed while the user exists in the vehicle 100, the occupant may feel discomfort due to the noise. According to the present disclosure, a fault diagnosis of the noise control device may be performed when the vehicle 100 is in non-operation (e.g., with no occupant in the vehicle).

Then, the controller 102 generates an acoustic signal with a predetermined frequency (e.g., 50+X Hz) and outputs the generated acoustic signal through the speaker 132 (304). In the acoustic signal '50+X Hz', X denotes an increment in frequency. That is, the frequency is increased by X Hz from 50 Hz. For example, when X=50 Hz, the controller 102 generates acoustic signals in a range of frequencies of 50 Hz to 500 Hz for diagnosing a fault of the noise control device in the order of frequencies of 50 Hz, 100 Hz, 150 Hz, 200 Hz, . . . and 500 Hz, while performing the fault diagnosis on the noise control device. The acoustic signal output through the speaker 132 vibrates a part of the vehicle body panel of the vehicle 100. That is, the speaker 132 and the part of the vehicle body panel serve as an exciter that causes vibration.

When an acoustic signal is output through the speaker 132, the acoustic signal excites a part of the vehicle body panel of the vehicle 100, causing vibration. The controller 102 detects the vibration caused by the acoustic signal output through the speaker 132, through the acceleration sensor 114 (306).

In addition, the controller 102 detects the acoustic signal output through the speaker 132, through the microphone 112 (308).

The controller 102 checks whether information related to the acoustic signal output through the speaker 132 matches vibration information detected through the acceleration sensor 114 on the basis of the vibration information obtained through the acceleration sensor 114(310). In other words, the controller 102 checks whether the detected vibration and the detected acoustic signal correspond to a vibration and an acoustic signal with a frequency of 50+X Hz. For example, when the frequency of the acoustic signal output through the speaker 132 is 50 Hz, the controller 102 checks whether vibration information detected through the acceleration sensor 114 corresponds to vibration caused by an acoustic signal with 50 Hz, to thereby check whether vibration corresponding to the acoustic signal output through the speaker 132 is normally detected through the acceleration sensor 114.

When vibration corresponding to the acoustic signal output through the speaker 132 is normally detected through the acceleration sensor 114 (YES (normal) in 310), the controller 102 increments the frequency of the acoustic signal output through the speaker 132 by X (312). For example, when 'X=50 Hz', the controller 102 generates acoustic signals in a range of 50 Hz to 500 for diagnosing a fault of the noise control device in the order of frequencies of 50 Hz, 100 Hz, 150 Hz, 200 Hz, . . . and 500 Hz, while repeating the fault diagnosis of the noise control device.

In addition, the controller 102 checks whether the increment value X reaches 450 Hz (314). In this case, the acoustic signals generated for the fault diagnosis are in a frequency range of 50 Hz to 500 Hz. Adding the maximum increment value of 450 Hz to the initial frequency of 50 Hz results in 500 Hz, that is, the maximum value in the frequency range of the acoustic signals. Accordingly, the fault diagnosis is terminated when the increment value reaches 450 Hz.

When vibration corresponding to the acoustic signal output through the speaker 132 is not normally detected through the acceleration sensor 114 (NO (failure) in 310), the controller 102 determines that a part of the noise control device has a fault, and stores an error code indicating the fault of the noise control device in the memory 142 (322). After storing the error code, the controller 102 returns to operation 312, and performs the subsequent processes until the frequency of the acoustic signal reaches 500 Hz.

When the user opens the door of the vehicle 100 and turns on ignition of the engine (ignition-on), the controller 102 displays an error code stored in the memory 142 on the cluster of the vehicle 100 (324). Displaying such an error code allows the user (driver) to recognize occurrence of a fault of the noise control device of the vehicle 100, and take an action to correct the fault.

The series of processes shown in FIG. 3 is directed to any one of the seats (e.g., a driver's seat) provided in the vehicle 100. The series of processes shown in FIG. 3 may be performed not only on the driver's seat but also on the passenger seat, the left rear seat, and the right rear seat in the sequence, so that the fault diagnosis may be performed with all the microphones and acceleration sensors 114 described above with reference to FIG. 2.

As is apparent from the above, the vehicle and the method of controlling the same can accurately detect an occurrence of a fault of a noise control device of a vehicle and indicate a result of the detection to a user upon occurrence of a fault such that the user handles the fault.

The above description of the present disclosure is for illustrative purposes, and a person having ordinary skilled in the art should appreciate that other specific modifications may be easily made without departing from the technical spirit or essential features of the present disclosure. Therefore, the above embodiments should be regarded as illustrative rather than limitative in all aspects. The scope of the disclosure is not to be limited by the detailed description set forth above, but by the accompanying claims of the present disclosure, and it should also be understood that all changes or modifications derived from the definitions and scope of the claims and their equivalents fall within the scope of the present disclosure.

The invention claimed is:

1. A method of controlling a vehicle comprising:

checking whether the vehicle is in non-operation based on the state of an engine and a door of the vehicle;

outputting an acoustic signal having a predetermined frequency through a speaker when the vehicle is in non-operation;

detecting, by a microphone, the acoustic signal output through the speaker;

detecting, by an acceleration sensor, a vibration generated by the acoustic signal output through the speaker;

determining, by a controller, that a fault has occurred when the detected acoustic signal and the detected vibration mismatch the acoustic signal having the predetermined frequency; and displaying, on a display, an error code corresponding to the fault when it is determined that the fault has occurred.

2. The method of claim 1, wherein the vehicle is determined to be in non-operation when the engine of the vehicle is in ignition-off and the door of the vehicle is locked.

3. The method of claim 1, wherein the error code is an error code indicating a fault of a noise control device.

4. The method of claim 1, wherein the vibration is a vibration generated by the acoustic signal, output through the speaker, which vibrates a vehicle body panel of the vehicle.

5. The method of claim 4, wherein the vibration is detected through the acceleration sensor.

6. The method of claim 1, wherein the predetermined frequency is continuously increased by a predetermined increment within a predetermined range of frequencies.

7. The method of claim 1, wherein the speaker for outputting the acoustic signal, the microphone for detecting the acoustic signal, and the acceleration sensor for detecting the vibration are provided in each of seats of the vehicle, and the determining of the fault is sequentially performed on each of the seats.

8. A vehicle comprising:

a speaker configured to output an acoustic signal having a predetermined frequency;

a microphone configured to detect the acoustic signal output through the speaker;

an acceleration sensor configured to detect a vibration generated by the acoustic signal output through the speaker; and a controller configured to check whether the vehicle is in non-operation, determine that a fault has occurred when the detected acoustic signal and the detected vibration mismatch the acoustic signal having the predetermined frequency while the vehicle is in non-operation, and display an error code on a display corresponding to the fault when it is determined that the fault has occurred.

9. The vehicle of claim 8, wherein the controller outputs the acoustic signal having the predetermined frequency when the vehicle is in non-operation.

10. The vehicle of claim 9, wherein the controller determines the vehicle to be in non-operation when an engine of the vehicle is in ignition-off and a door of the vehicle is locked.

11. The vehicle of claim 8, wherein the error code is an error code indicating a fault of a noise control device.

12. The vehicle of claim 8, wherein the vibration is a vibration generated by the acoustic signal, output through the speaker, which vibrates a vehicle body panel of the vehicle.

13. The vehicle of claim 8, wherein the predetermined frequency is continuously increased by a predetermined increment within a predetermined range of frequencies.

14. The vehicle of claim 8, wherein the speaker, the microphone, and the acceleration sensor are provided in each of seats of the vehicle, and the determining of the fault is sequentially performed on each of the seats.

* * * * *